United States Patent [19]

Killy

[11] 3,987,892

[45] Oct. 26, 1976

[54] DISPLAY CARTON

[75] Inventor: Earl J. Killy, Monroe, La.

[73] Assignee: Olinkraft, Inc., West Monroe, La.

[22] Filed: Aug. 13, 1975

[21] Appl. No.: 604,420

[52] U.S. Cl. ..... 206/44 R; 206/443; 206/459; 206/538; 229/28 R; 229/29 F

[51] Int. Cl.[2] ..... B65D 5/48; B65D 85/40

[58] Field of Search ..... 206/44 R, 45.29, 45.3, 206/459, 461–471, 443, 538; 229/3.5 R, 48 R, 48 SA, 28 R, 29 F; 211/72, 73

[56] References Cited

UNITED STATES PATENTS

| | | | |
|---|---|---|---|
| 2,066,495 | 1/1937 | Swift | 229/48 SA X |
| 2,123,903 | 7/1938 | Lane et al. | 229/48 SA X |
| 2,330,045 | 9/1943 | Georgiou | 229/48 R X |
| 2,661,141 | 12/1953 | Zinn, Jr. | 229/48 R X |
| 2,833,457 | 5/1958 | Tyrseck | 229/28 R |
| 2,954,912 | 10/1960 | Kauffeld | 229/48 R X |
| 3,112,827 | 12/1963 | Gerber | 206/466 |
| 3,167,179 | 1/1965 | Goldstein | 206/44 R |
| 3,450,256 | 6/1969 | Chandler et al. | 206/461 |

FOREIGN PATENTS OR APPLICATIONS

| | | | |
|---|---|---|---|
| 483,933 | 8/1917 | France | 229/29 F |

*Primary Examiner*—William Price
*Assistant Examiner*—Stephen Marcus
*Attorney, Agent, or Firm*—Norvell E. Von Behren; Donald W. Marks

[57] ABSTRACT

A new and novel display carton for displaying a plurality of uprightly positioned articles within the carton. The display carton is formed in a one-piece construction and has an integral advertising panel formed at the rear portion of the carton with the advertising panel being rigidly fastened to the folded back panel of the carton. By the use of an elongated slot in the folded back panel, a paper-to-paper bond is obtainable between the back of the advertising panel and the folded back panel to strengthen the connection.

9 Claims, 10 Drawing Figures

DISPLAY CARTON

BACKGROUND OF THE INVENTION

This invention relates generally to product display cartons, and more particularly, to a new and improved one-piece display carton for displaying a plurality of articles in an upright position.

It is known in the prior art to form product display cartons having an intermediate panel positioned within the carton for the purpose of aiding in retaining the display article upright in the carton. Such intermediate panels may be formed out of the same production blank from which were formed the original display carton or may also be formed separate from a separate production blank and glued in place in the display carton. Prior art cartons of the type referred to, when utilizing a back advertising panel, generally would hav the advertising panel separately attached to the back of the display carton either by glueing or by the use of a series of slots cut in the rear portion of the display carton into which would fit a series of tabs formed on the separate advertising panel. Such cartons were expensive to manufacture and required additional time to set up the carton in order to attach the separate advertising panel to the product display carton.

A one-piece prior art product display carton having an integral back advertising panel is shown in the U.S. Pat. No. 2,990,056, issued to E. E. Gillam on June 27, 1961. This carton, while being formed in a one-piece construction, does not have formed therein an integral intermediate panel which is utilized for the supporting of the product displayed within the carton and as is taught by the applicant's new and novel carton. The display carton of the subject patent, while satisfactory for a short product which can be retained upright on its own base, is not satisfactory for an elongated product of the type utilized by the applicant. Such an elongated product generally contains no base as for example a product of tile and tube caulking of the type sold in retail stores for use in repairing bathtubs. With such a product it is necessary to form an intermediate panel within the carton to operate in conjunction with the top panel to retain the articles in a generally upright position.

Other prior art display devices of various configurations are cited herein to show the state of the art and are shown in the U.S. Pat. No. 3,390,783, issued to J. P. Quackenbush, Jr., on July 2, 1968; the U.S. Pat. No. 3,375,934, issued to E. A. Bates, on Apr. 2, 1968; the U.S. Pat. No. 3,682,597, issued to R. L. Husch, on Aug. 8, 1972; and the U.S. Pat. No. 2,654,496, issued to C. G. Fulmer, et al, on Oct. 6, 1953.

SUMMARY OF THE INVENTION

In order to overcome the problems inherent in the prior art devices cited and to provide a new and novel improved product display carton, there is provided by the subject invention a much improved product display carton which may be formed from a one-piece production blank and which has formed therein an integral intermediate panel alongwith an integral back advertising panel which is held in a generally upright position by a folded back panel of the subject display carton. The advertising panel is glued to the folded back panel with a paper-to-paper bond thereby providing a much stronger bond between the respective panels.

Accordingly, it is an object and advantage of the invention to provide a new and novel one-piece product display carton which may be utilized for elongated articles to retain them in a generally upright position by the use of an intermediate panel formed integrally within the carton.

Yet another object and advantage of the invention is to provide a new and novel product display carton which may be formed in a one-piece construction and may be quickly and easily assembled by the ultimate purchaser of the carton thereby eliminating costly setup time for the display carton.

Still yet another object and advantage of the invention is to provide a new and novel one-piece product display carton which has a unique folded construction whereby the intermediatae panel may be formed from the same construction blank and the advertising panel may also be formed from that same blank with the advertising panel being bonded to a rear panel of the display carton in a paper-to-paper bond.

These and other objects and advantages of the invention will become apparent from a review of the foregoing specification and from a study of the drawings detailing the preferred embodiment.

DESCRIPTION OF THE PREFERRED EMBODIMENT

Figure 2:
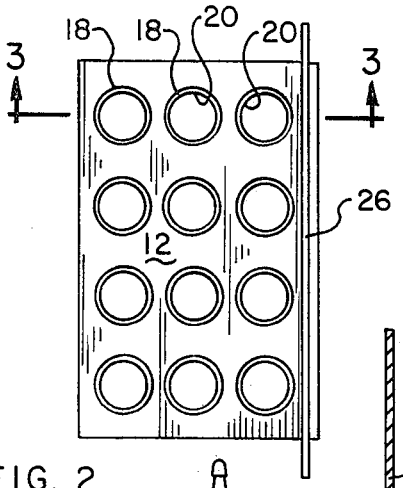
FIG. 2 is a top view, taken along line 2—2 of FIG. 1.
Figure 3:
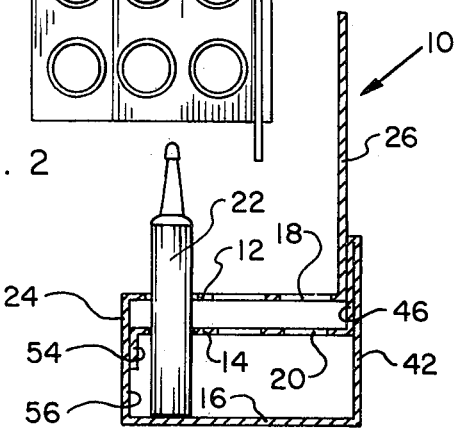
FIG. 3 is a sectional view, taken along line 3—3 of FIG. 2, showing the folded construction of the subject display carton.
Figure 1:
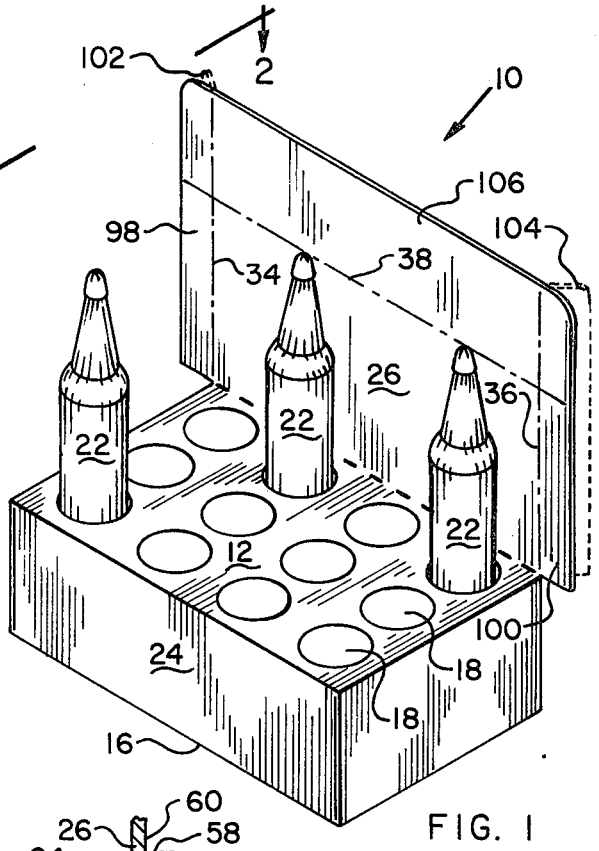
FIG. 1 is a perspective view of the subject display carton shown in its setup position and also shown with a plurality of elongated articles displayed within the carton.

Referring now to the drawings in general and in particular to FIGS. 1 and 3 of the drawing, there is shown the subject display carton generally by the numeral 10 which comprises a generally rectangular box shaped product display section havng formed therein a top panel 12, an intermediate panel 14, and a bottom panel 16. The top panel 12 has a plurality of product receiving openings 18 formed in the panel while the intermediate panel 14 has a plurality of product receiving openings 20 formed in that panel. When formed thusly, the display carton 10 may be utilized to retain a plurality of elongated products 22 in a generally upright position within the display carton whenever the products are positioned within the openings 18 and 20 and rest on the bottom panel 16 of the subject carton.

Connecting the top panel 12 and the bottom panel 16 is a front panel 24. Formed at the rear of the top panel 12 is an advertising panel 26 which is positioned uprightly and generally contains advertising for the product contained within the display carton.

Figure 4:
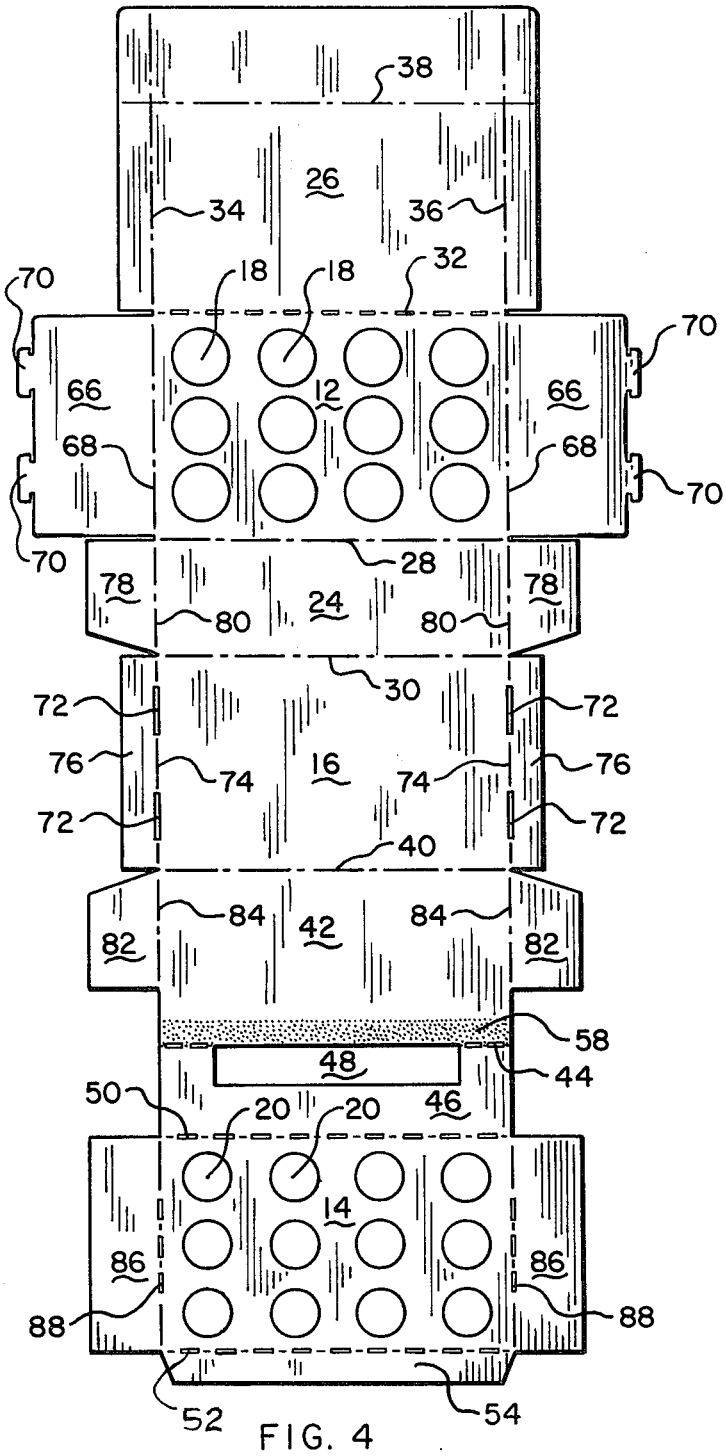
FIG. 4 is a plan view of the production blank of the subject product display carton shown prior to its being folded and after having had a predetermined quantity of adhesive applied to the first back panel.

Referring now to FIG. 4 of the drawing there will be shown in more detail the particular production blank for the subject display carton and how it is formed so that it can be erected into the display carton shown in FIG. 1 of the drawing. In particular, referring to FIG. 4 of the drawing there is shown a plan view of the production blank of the subject invention before described, which is formed from a plurality of panels hingedly attached to each other. For example, the top panel 12 is hingedly attached, by means of the scoreline 28 to the front panel which is also hingedly attached by means of the scoreline 30 to the bottom panel. The advertising panel 26 is hingedly attached, by means of the cut and scorelines 32 to the top panel 12 and has formed thereon a plurality of scorelines 34, 36 and 38 for the purposes which will be described more fully hereinafter.

The bottom panel 16 is hingedly connected, by means of the scoreline 40, to a first back panel 42 which is also hingedly connected, by means of the cut and scorelines 44, to a second back panel 46. The second back panel 46 has formed therein an elongated slot or opening 48 for the purpose which will be described more fully hereinafter. Hingedly connected to the second back panel 46, by means of the cut and scorelines 50 is the intermediate panel 14 which has been before described. Formed on the intermediate panel 14, by means of the cut and scorelines 52, is a tab 54.

Figure 5:
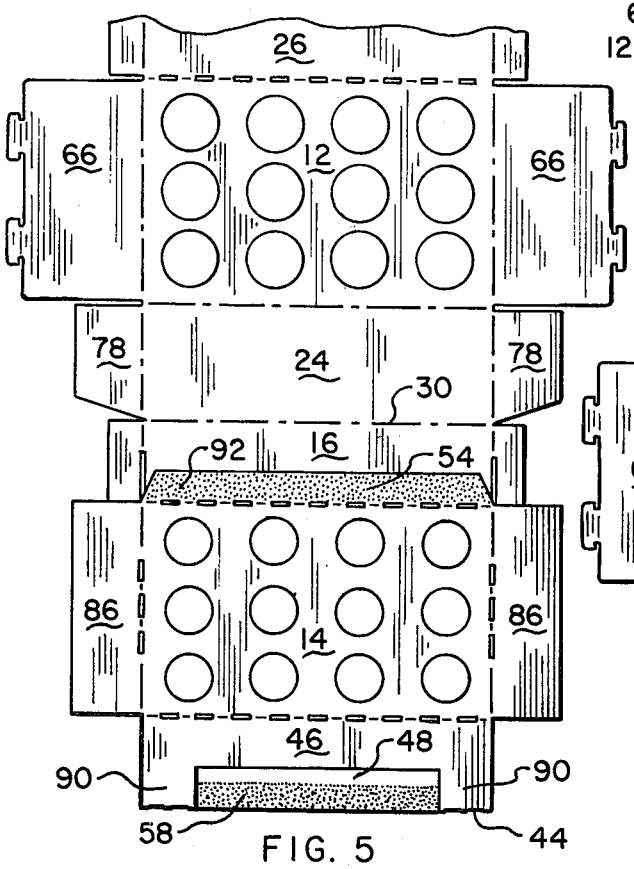
FIG. 5 is a plan view of the production blank shown in FIG. 4 of the drawing showing the first folding sequence of folding the production blank into the final configuration from which is formed the diplay carton shown in FIG. 1.
Figure 6:
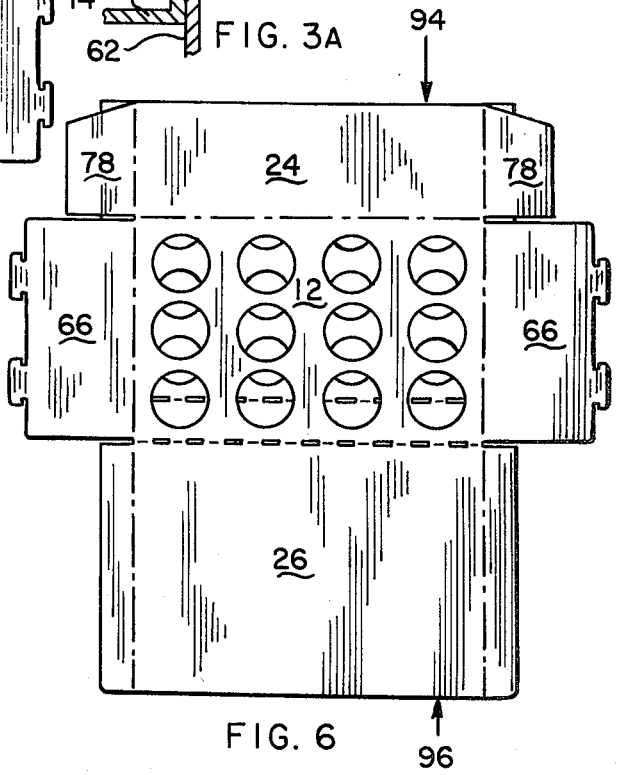
FIG. 6 is a plan view showing the next sequence in the folding operation after that shown in FIG. 5 of the drawing.

By referring to FIG. 3 of the drawing there is shown how the respective panels are eventually folded into position to form the upright display carton shown in FIG. 1 of the drawing. The tab 54 is glued to the back side 56 of the front panel 24 as shown in FIG. 3 of the drawing. The application of the glue to the tab 54 will be described more in detail when referring to the folding sequence of the product display carton as shown in FIGS. 5 and 6.

Figure 3A:
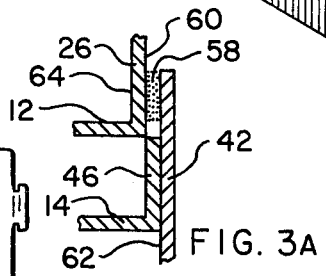
FIG. 3A is an enlarged sectional view of the back panel portion of the carton shown in FIG. 3 showing the paper-to-paper bonding of the back panel to the advertising panel.

Referring now to FIGS. 3 and 3A, there will be described how the advertising panel 26 is glued to the first back panel 42 by the use of the elongated slot 48. As can be seen in FIG. 4 of the drawing, a predetermined quantity of glue 58 shown by the strippled area, had been applied to the production blank in the proximity of the elongated slot 48 on the first back panel 42. During the folding sequence in folding the carton about the cut and scoreline 44, it can be seen in FIG. 5 of the drawing how the glue 58 is exposed through the elongated slot 48. From this it then becomes apparent, by referring to FIG. 3A of the drawing, how the exposed glue 58 is then adherred to the back side 60 of the advertising panel 26 through the slot 48 whenever the carton is folded in the position shown in FIGS. 3 and 3A.

When erected and glued thusly, it can be seen that a paper-to-paper bond is obtained between the back side 60 of the advertising panel and the back side 62 of the first back panel 42. The reason for this is that whenever the production blank shown in FIG. 4 is formed the front side 64 of the entire blank is generally clay-coated on one side for the express purposes of providing a better surface for printing the carton with advertising display. The back side of the carton including the back side 60 of the advertising panel is generally left uncoated or in its natural kraft paper state. From this it can be seen that the uncoated back side 60 of the advertising panel and the uncoated back side 62 of the first back panel 42 are able to be glued together by means of the glue 58 thereby resulting in a much stronger bond between the two panels.

Referring now to FIG. 4 of the drawing and then to FIGS. 5 and 6 there will be described the remaining portions of the production blank and how the production blank is folded in FIGS. 5 and 6 to form the erected product display carton.

The top panel 12 has formed on each side thereof a hinged side flap 66 by means of the scoreline 68. The hinged side flaps 66 have formed on the ends thereof a pair of locking tabs 70 which are designed to engage in a pair of slots 72 formed on the scorelines 74 on the bottom panel 16. The scorelines 74 allow a flap 76 to be formed on the sides of the bottom panel 16. Also formed on the sides of the front panel 24 are flaps 78 which are formed by means of the scorelines 80. In a similar manner the first back panel 42 has formed on the sides thereof flaps 82 by means of the scorelines 84. In a similar manner, the intermediate panel 14 has formed on the sides thereof flaps 86 by means of the cut and scorelines 88.

Referring now to FIGS. 5 and 6 of the drawing there is shown the folding sequence wherein the production blank shown in FIG. 4 is folded to its final configuration whereupon it is easily erected into the upright display carton shown in FIGS. 1, 3 and 3A of the drawing by means well known in the art. As before mentioned, the first back panel 42 has a predetermined quantity of glue 58 applied to the panel in the proximity of the elongated slot 48 whereupon the second back panel 46 and the intermediate panel 14 are folded along the cut and scorelines 44 to the position shown in FIG. 5 of the drawing. When folded in this manner, the first back panel 42 would be glued to the second back panel 46 at the areas 90 shown in FIG. 5 of the drawing with the glue 58 being available for application to the back side 60 of the advertising panel. In order to glue the tab 54 to the back side 56 of the front panel 24, a predetermined quantity of glue 92, shown by the stippled area, would be applied to the tab 54.

Thereafter the next step in the folding sequence is to fold the front panel 24 and the top panel 12 along with the advertising panel 26 about the scoreline 30 to glue the tab 54 to the back side 56 of the front panel 24 and also to glue the previously applied glue 58 on the first back panel 42 to the back side 60 of the advertising panel 26. This is the position that the carton is shown in on the drawing FIG. 6 and would be the final position of the carton prior to its being erected to the opened carton shown in FIGS. 1, 3 and 3A of the drawing.

When being erected from the position shown in FIG. 6 of the drawing, a predetermined minimal force is applied in the direction of the arrow 94 to the front panel 24 while a predetermined force is applied in the direction of the arrow 96 to the advertising panel 26 to open the carton to its erected position. This predetermined force can be applied either by hand or in a machine designed specifically to open the cartons to an erected position.

Figure 7:
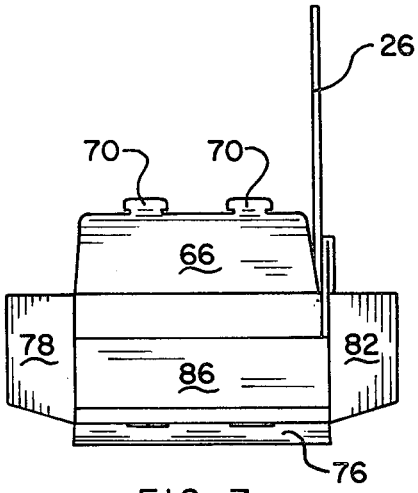
FIG. 7 is an end view of the folded display carton after it has been set up prior to the folding of the end flaps into their closed position.
Figure 8:
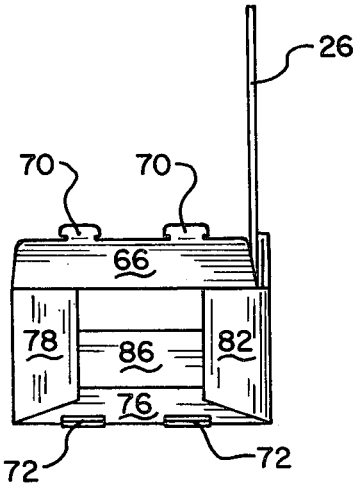
FIG. 8 is an end veiw of the display carton similar to FIG. 7 showing a portion of the end flaps folded inwardly and prior to closing of all of the end flaps and locking them in position.
Figure 9:
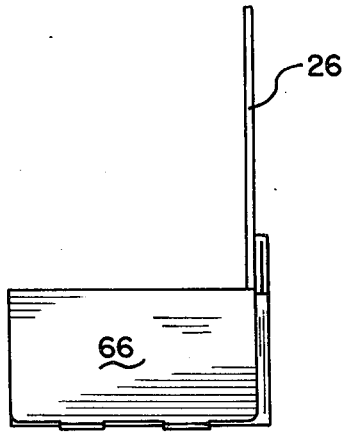
FIG. 9 is an end view of the display carton showing the end flaps all locked into position which aids in retaining the advertising panel in a generally upright position.

Referring now to FIGS. 7, 8 and 9 there are shown end views of the folded display carton after it has been set up, but before the flaps have been closed on the ends of the display carton. In the folding sequence for closing the ends of the carton, the flaps 86 on the intermediate panel 14 are folded downwardly first as shown in FIG. 7 of the drawing whereupon the flaps 76 on the bottom panel 16 are folded upwardly as shown in FIG. 8 of the drawing and the flaps 78 on the front panel 24 along the flaps 82 on the first back panel 42 are folded inwardly. Thereafter the hinged side flaps 66 on the top panel 12 are folded downwardly as shown in FIG. 9 of the drawing and the locking tabs 70 are positioned within the slots 72 formed between the bottom panel 16 and the tabs 76 to tightly lock all of the respective flaps together in a closed position. Both sides of the carton would be folded in a similar manner. When the flaps are folded thsuly and are tightly locked in position by means of the locking tabs 70 as shown in FIG. 9 of the drawing, it can be readily seen that the flaps aid in retaining the advertising panel in a generally upright position since they structurally complete the generally rectangular box shaped product display section into a closed configuration.

Referring now back to FIG. 1 of the drawing there will be described the purposes of the scorelines 34, 36 and 38. Whenever it is desirous to insure that the advertising panel 26 remain in an upright position and to prevent its being accidentally folded downwardly, it may be desirous to fold the advertising panel 26 along the scorelines 34 and 36 and which would fold the panel areas 98 and 100 backwards somewhat into the position shown by the dashed lines 102 and 104. When folded thusly, the panels 98 and 100 in combination with the scorelines 34 and 36 form a strengthening channel on the advertising panel 26 which will tend to aid in retaining the advertising panel in an upwardly and generally vertical position at all times.

When the product display carton 10 is shipped to the retailer, it is generally shipped in multiple quantity packages within an outer box or protective carton. In such cases, it is desirous to be able to protect the tops of the products 22 which are packaged in the carton and to prevent them from being dislodged in the carton during shipment. As a result, the scoreline 38 has been provided horizontally along a mid portion of the advertising panel 26 as shown in FIG. 1 of the drawing which allows the advertising panel to be folded along the scoreline 38 downwardly and forwardly over the tops of the product 22 to allow the panel area 106 to cover the tops of the products 22 to protect the products and to also retain the products within the general package area during shipment. Previous to folding the panel 106 downwardly into the horizontal position, the panels 98 and 100 are folded 180° into juxtaposition with the back side 60 of the advertising panel which allows the entire carton with its contents to be packaged tightly within an outer box or carton for shipment to the retailer of the product.

From the above it can be seen that there has been provided by the subject invention, a new and novel product display carton which may be utilized for displaying a plurality of uprightly positioned articles within the carton with the carton being formed in a one-piece construction and having an integral advertising panel formed at the rear portion with the advertising panel being rigidly fastened to the folded back panel of the carton in a paper-to-paper bond. By the use of the new and novel elongated slot in the folded back panel, a much improved bond is obtained between the back of the advertising panel and the folded back panel. It is to be understood that various changes and modifications in the display carton may be made by those skilled in the art without departing from the spirit and scope of the invention as claimed.

Having thusly described my invention, I claim:

1. A one piece display carton comprising a. a generally rectangular box shaped product display section having formed therein a top panel, an intermediate panel and a bottom panel;

b. a front panel hingedly connecting said top panel to said bottom panel;

c. first and second folded back panels hingedly connecting said intermediate panel to said bottom panel, the first back panel being hinged on the bottom panel, the second back panel being hinged on the intermediate panel, and a portion of said first and second folded back panels extending above said top panel;

d. a generally upright advertising panel formed at the rear portion of said display section;

e. means, formed on at least a one of said panels, for locking at least a portion of said panels together and for retaining said advertising panel in a generally upright position;

f. said panels being formed from a one piece production blank;

g. said second back panel having formed therein an opening between respective portions of said first back panel and said advertising panel; and h. said first back panel being glued through the opening in the second back panel to the advertising panel.

2. The display carton as defined in claim 1 wherein said one piece production blank is coated on a front side thereof with a clay coating and is uncoated on the back side, said opening serving to allow an uncoated portion of said first back panel to be glued to an uncoated portion of the advertising panel thereby obtaining a stronger adhesive bond.

3. The display carton as defined in claim 1 wherein said locking and retaining means comprises said top panel having formed thereon a pair of hinged side flaps which are fixedly attached to said bottom panel.

4. The display carton as defined in claim 3 further comprising said front and folded back panel having formed thereon a pair of flaps and further comprising said bottom panel and said intermediate panel having formed thereon a pair of flaps said flaps being folded inwardly and beneath said hinged side flaps to thereby aid in retaining said advertising panel in a generally upright position.

5. A display carton comprising a. a generally vertical advertising panel;

b. a generally horizontal top panel hingedly attached to said advertising panel, said top panel having formed therein at least one product receiving opening;

c. a generally vertical front panel hingedly attached to said top panel;

d. a generally horizontal bottom panel hingedly attached to said front panel;

e. a generally vertical first back panel hingedly attached to said bottom panel;

f. a generally vertical second back panel hingedly attached to said first back panel;

g. a generally horizontal intermediate panel hingedly attached to said second back panel, said intermediate panel having formed therein at least one product receiving opening;

h. means, associated with at least a portion of of said panels, for retaining said intermediate panel in a generally horizontal position;

i. said second back panel having formed therein a horizontally elongated opening between respective portions of said first back panel and said advertising panel; and j. said first back panel being glued through the elongated opening to the back side of the advertising panel.

6. The display carton as defined in claim 5 wherein said means for retaining comprises a tab being formed on said intermediate panel and said tab being glued to said front panel.

7. A production blank for forming a display carton, comprising a. an advertising panel;

b. a top panel, hingedly attached to said advertising panel, said top panel having formed therein a plurality of product receiving openings;

c. a front panel hingedly attached to said top panel;

d. a bottom panel hingedly attached to said front panel;

e. a first back panel hingedly attached to said bottom panel;

f. a second back panel hingedly attached to said first back panel;

g. an intermediate panel, hingedly attached to said second back panel, said intermediate panel having formed therein a plurality of product receiving openings adapted to be vertically aligned with the respective product receiving openings in the top panel whenever said production blank is formed into a display carton;

h. at least one end flap, formed on at least one of said panels, for locking a portion of said panels together whenever said production blank is formed into a display carton; and i. said second back panel having formed therein an elongated opening along the hinge line between said first and second back panels for allowing said first back panel to be glued to the back of said advertising panel through the elongated opening.

8. The production blank as defined in claim 7 further comprising said top panel having formed on opposite ends thereof an end flap having at least one locking tab formed thereon and further comprising said bottom panel having formed on opposite ends thereof an end flap having a tab receiving die cut for receiving the locking tab formed on the top panel whenever said production blank is formed into a display carton.

9. The production blank as defined in claim 7 wherein said top panel, said front panel, said bottom panel, said first back panel and said intermediate panel all have formed thereon end flaps on opposite sides thereof for locking the respective panels together whenever said production blank is formed into a display carton.

* * * * *

UNITED STATES PATENT OFFICE

CERTIFICATE OF CORRECTION

PATENT NO. : 3,987,892

DATED : Oct. 26, 1976

INVENTOR(S) : Earl J. Killy

It is certified that error appears in the above-identified patent and that said Letters Patent are hereby corrected as shown below:

Column 1, Line 18, delete "hav" and insert in place thereof -- have --.

Column 1, Line 40, delete "tube" and insert in place thereof -- tub --.

Column 1, Line 52, delete 2,654,496 and insert in place thereof -- 2,654,469 --.

Column 1, Line 63, delete "alongwith" and insert -- along with --

Column 2, Line 16, delete "intermediatae" and insert in place thereof -- intermediate --.

Column 3, Line 59, delete "strippled" and insert in place thereof -- stippled --.

Column 5, Line 25, delete "thsuly" and insert -- thusly --.

Signed and Sealed this

Fifteenth Day of March 1977

[SEAL]

*Attest:*

RUTH C. MASON
*Attesting Officer*

C. MARSHALL DANN
*Commissioner of Patents and Trademarks*

UNITED STATES PATENT OFFICE

CERTIFICATE OF CORRECTION

PATENT NO. : 3,987,892

DATED : October 26, 1976

INVENTOR(S) : Earl J. Killy

It is certified that error appears in the above-identified patent and that said Letters Patent are hereby corrected as shown below:

Column 6, line 31, omit -- a --.

Column 7, line 13, following the word "of", omit -- of --.

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*